US005853317A

United States Patent [19]

Yamamoto

[11] Patent Number: 5,853,317

[45] Date of Patent: Dec. 29, 1998

[54] POLISHING PAD AND POLISHING APPARATUS HAVING THE SAME

[75] Inventor: Yoshiaki Yamamoto, Tokyo, Japan

[73] Assignee: NEC Corporation, Tokyo, Japan

[21] Appl. No.: 881,983

[22] Filed: Jun. 25, 1997

[30] Foreign Application Priority Data

Jun. 27, 1996 [JP] Japan ..... 8-167761

[51] Int. Cl.[6] ..... B24B 29/00

[52] U.S. Cl. ..... 451/288; 451/287; 451/530; 451/533; 451/527; 451/526; 451/921; 451/41; 451/548; 451/550; 451/446

[58] Field of Search ..... 451/288, 287, 451/530, 533, 527, 526, 921, 41, 548, 550, 446

[56] References Cited

U.S. PATENT DOCUMENTS

| | | | |
|---|---|---|---|
| 4,490,948 | 1/1985 | Hanstein et al. | 451/446 |
| 4,841,680 | 6/1989 | Hoffstein et al. | 451/533 |
| 5,533,923 | 7/1996 | Shamouillian et al. | 451/41 |
| 5,658,185 | 8/1997 | Morgan, III et al. | 451/60 |

FOREIGN PATENT DOCUMENTS

| | | | |
|---|---|---|---|
| 2100321 | 4/1990 | Japan | 451/446 |
| 5-13389 | 1/1993 | Japan . | |

*Primary Examiner*—Robert A. Rose

*Attorney, Agent, or Firm*—Ostrolenk, Faber, Gerb & Soffen, LLP

[57] ABSTRACT

A polishing pad made of a flexible material includes a first major surface, a second major surface, and a large number of holes. The first major surface is urged by a rotatable polishing target member to polish a polishing target surface of the urged polishing target member by using a slurry. The second major surface is adhered to a rotatable platen. The large number of holes extend between the first and second major surfaces and serve as slurry reservoirs. The holes have a larger opening area on the second major surface than that on the first major surface. A polishing apparatus is also disclosed.

8 Claims, 6 Drawing Sheets

POLISHING PAD AND POLISHING APPARATUS HAVING THE SAME

BACKGROUND OF THE INVENTION

The present invention relates to a polishing pad and a polishing apparatus and, more particularly, to a chemical mechanical polishing (CMP) apparatus for uniformly planarizing, by polishing, the complicated unevenness of a semiconductor device formed with semiconductor integrated circuits.

In recent years, along with increases in micropatterning and integration degrees for integrated semiconductor integrated circuits, the number of levels or layers in semiconductor integrated circuits has increased. As the semiconductor integrated circuits become micropatterned and multilayered, the focus margin of an aligner that transfers the pattern decreases. Global planarization of an insulating interlayer film and the like on the silicon substrate is thus necessary.

Conventionally, many methods have been developed concerning planarization of the insulating interlayer film. An example of such methods includes the reflow method, the coating method, e.g., SOG (Spin On Glass), the etch back method, and the like. With these methods, however, global planarization is difficult to achieve. For this reason, conventionally, the CMP (Chemical Mechanical Polishing) method of mechanically and chemically polishing the insulating interlayer film and the like on the silicon substrate has been employed.

As shown in FIG. 6, a semiconductor wafer 1 is manufactured by forming, by a CVD (Chemical Vapor Deposition) method, a thick insulating interlayer film 4 on an aluminum interconnection 3 formed on an insulating film 2 on the major surface of a semiconductor substrate. According to the CMP method, the semiconductor wafer is mounted on a chemical mechanical polishing apparatus (not shown in FIG. 6), and the insulating interlayer film 4 which forms an uneven surface 5 due to the presence of the aluminum interconnection 3 is polished to have a flat surface 6.

As shown in FIG. 7A, this chemical mechanical polishing apparatus has a platen 41, an underlayer sheet (waterproof sheet) 42, a polishing pad 40, a wafer carrier 44, and a slurry supply unit 46. The platen 41 rotates together with its rotating shaft 43. The underlayer sheet 42 is adhered on the platen 41. The polishing pad 40 is adhered on the underlayer sheet 42. The wafer carrier 44 rotates together with its rotating shaft 45 and urges the semiconductor wafer 1 against the platen 41. The slurry supply unit 46 feeds a slurry 47.

The semiconductor wafer 1 is rotated by the rotating shaft 45 as the wafer is fixed on the wafer carrier 44 with its uneven surface facing downward. The rotating semiconductor wafer 1 is further urged by the rotating polishing pad 40 and is polished with the slurry 47 fed by the slurry supply unit 46.

During polishing, the rotating shaft 45 and the wafer carrier 44 are biased toward the platen 41 with a predetermined pressure. As shown in FIG. 7B, the semiconductor wafer 1 bites into the surface of the polishing pad 40. Therefore, the slurry 47 does not reach the central portion of the semiconductor wafer 1. As a result, the polishing rate at the central portion of the semiconductor wafer 1 decreases, and the surface of the semiconductor wafer 1 is not uniformly planarized.

In order to solve this problem, a polishing pad as shown in FIGS. 8A and 8B is commercially available in which a large number of holes 21 are formed in a polishing pad 20 on an underlayer sheet 22 so that a slurry is reserved in the holes 21. These holes 21 serving as the slurry reservoirs are formed to extend from the upper surface to the lower surface of the polishing pad 20 such that its cross sections have the same inner diameter, i.e., such that its cross sections have the same area. For example, as shown in FIG. 9, holes each having a diameter of 2 mm are formed to extend through the polishing pad 20 having a thickness of 2 mm.

With this arrangement, the slurry is fed also to the central portion of the wafer, so that the uniformity in polishing on the wafer surface improves.

Japanese Patent Laid-Open No. 5-13389 proposes a technique as shown in FIGS. 10A and 10B. According to this technique, a slurry 33 is fed not from above a polishing pad 30, but holes 31 are formed in the polishing pad 30 and a platen 32 so that the slurry 33 is fed from below the platen 32. Several slurry supply units 34 are arranged such that they can individually control the feed amount of the slurry 33, and thereby achieve uniforming polishing.

In the polishing pad 20 shown in FIGS. 8A and 8B and FIG. 9, however, since the holes 21 serving as the slurry reservoirs have the same cross section area from the upper surface to the lower surface of the polishing pad 20, only a small mount of slurry is reserved in the holes 21, and the amount of slurry fed to the surface of the semiconductor wafer is insufficient.

As shown in FIGS. 10A and 10B, when the slurry 33 is to be fed from below the polishing pad 30, since the slurry supply units 34 is arranged on the rotating shaft side of the platen 32, the arrangement of the polishing apparatus is very complicated.

SUMMARY OF THE INVENTION

It is an object of the present invention to provide a polishing pad and a polishing apparatus capable of feeding a necessary amount of slurry onto the polishing surface with a simple arrangement.

It is another object of the present invention to provide a polishing pad and a polishing apparatus capable of uniformly planarizing the polishing target surface of the polishing target member.

In order to achieve the above objects, according to the present invention, there is provided a polishing pad made of a flexible material, the polishing pad comprising a first major surface urged by a rotatable polishing target member to polish a polishing target surface of the urged polishing target member by using a slurry, a second major surface adhered to a rotatable platen, and a large number of holes extending between the first and second major surfaces and serving as slurry reservoirs, the holes having a larger opening area on the second major surface than that on the first major surface.

DESCRIPTION OF THE PREFERRED EMBODIMENT

The present invention will be described in detail with reference to the accompanying drawings.

Figure 1:
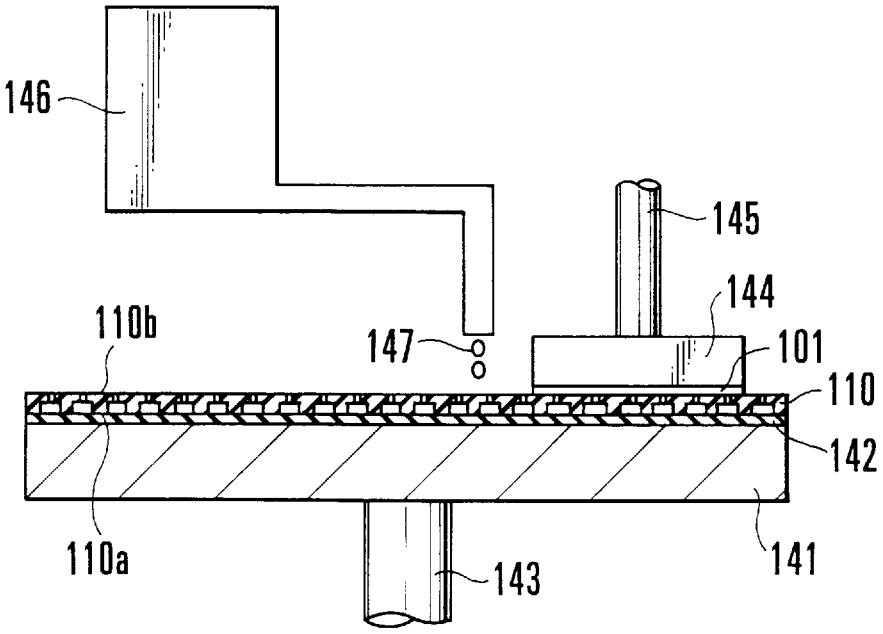
FIG. 1 is a schematic view showing the arrangement of a polishing apparatus according to an embodiment of the present invention.

FIG. 1 shows the arrangement of a semiconductor wafer polishing apparatus according to an embodiment of the present invention. A platen portion is indicated in section. Referring to FIG. 1, a platen 141 is fixed on a rotating shaft 143 to rotate with it. An underlayer sheet 142 is adhered on the platen 141. A polishing pad 110 has an adhesion surface 110*a* adhered on the underlayer sheet 142, and a contact surface 110*b* against which a polishing target member is urged. The polishing pad 110 is made of a flexible member, and has a large number of holes serving as stepped polishing reservoirs to be described later.

A wafer carrier 144 is fixed on a rotating shaft 145 to rotate with it, and supports a semiconductor wafer 101 which is urged against the polishing pad 110 on the platen 141 during polishing. A slurry supply unit 146 feeds a slurry 147 to the semiconductor wafer 101 which is being polished.

Figure 2A:
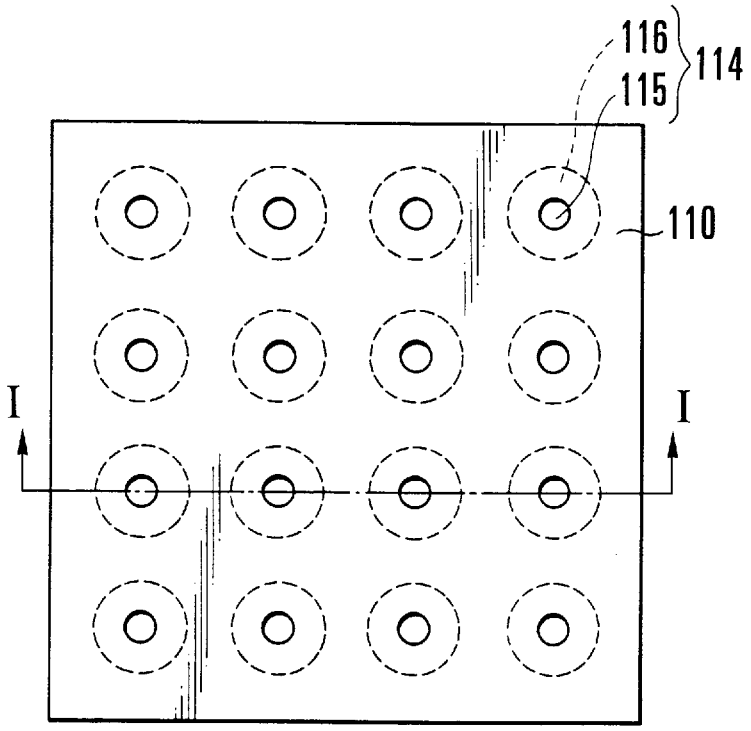
FIG. 2A is a plan view of a polishing pad shown in FIG. 1.
Figure 2B:
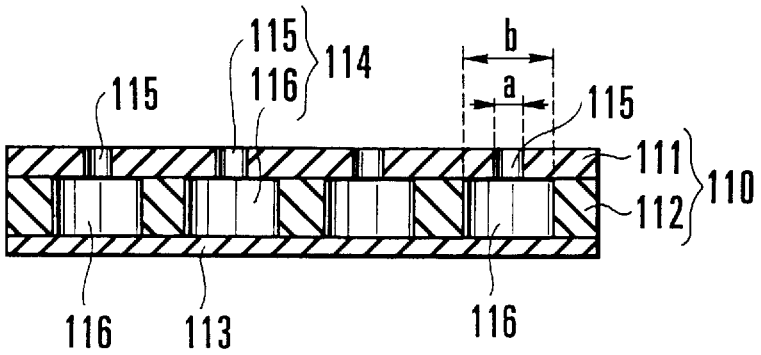
FIG. 2B is a sectional view taken along the line I—I of FIG. 2A.

The polishing pad 110 shown in FIG. 1 will be described in detail with reference to FIGS. 2A and 2B. As shown in FIG. 2B, the polishing pad 110 adhered on an underlayer sheet 113 is constituted by an upper first polishing pad layer 111 and a lower second polishing pad layer 112.

The first polishing pad layer 111 is made of, e.g., a sheet obtained by slicing foamed polyurethane to a thickness of about 1 mm. A large number of holes 115 each having a diameter of a are formed in the first polishing pad layer 111 by punching. Similarly, the second polishing pad layer 112 is also made of a sheet obtained by slicing foamed polyurethane to a thickness of about 1 mm. A large number of holes 116 each having a diameter b larger than a (a <b) are formed in the second polishing pad layer 112 by punching to correspond to the holes 115.

The major surfaces of the first and second polishing pad layers 111 and 112 are adhered to each other, and the corresponding holes 115 and 116 form holes 114 having convex longitudinal sections and serving as slurry reservoirs. As shown in FIG. 2A, the holes 114 are arranged in a matrix.

The semiconductor wafer polishing operation of the polishing apparatus shown in FIG. 1 will be described.

Figure 3:
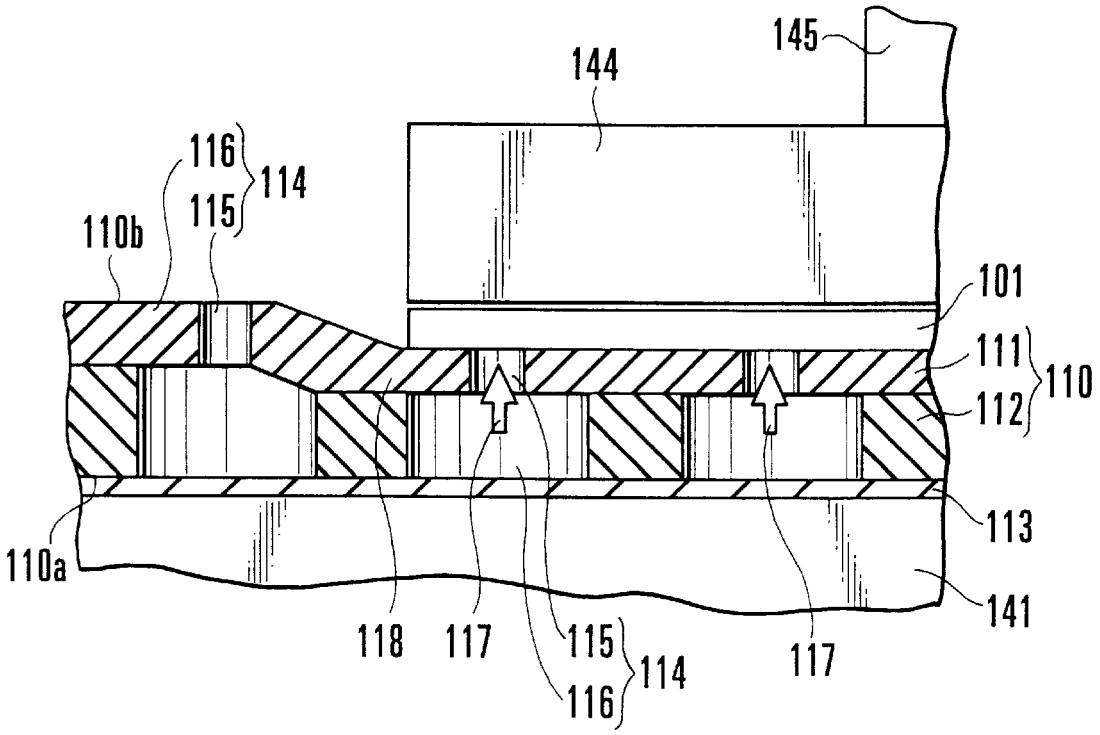
FIG. 3 is an enlarged sectional view of the main part of the polishing apparatus shown in FIG. 1 in order to explain its polishing operation.

During polishing, the semiconductor wafer 101, which is supported by the wafer carrier 144 such that the surface to be polished faces downward and is rotated by the rotating shaft 145, is urged against the polishing pad 110 on the platen 141 which is rotating. At this time, since a polishing pressure is applied to the semiconductor wafer 101 from the rotating shaft 145 through the wafer carrier 144, the polishing pad 110 is compressed by the semiconductor wafer 101, as shown in FIG. 3.

The region of the polishing pad 110 which is compressed by the semiconductor wafer 101 shifts as the polishing pad 110 rotates. Within a region of the polishing pad 110 which is not compressed by the semiconductor wafer 101, a slurry 117 fed from the slurry supply unit 146 is reserved in the holes 114. Within the region of the polishing pad 110 which is compressed by the semiconductor wafer 101, the holes 114 themselves are also compressed. Therefore, the slurry 117 reserved in the holes 116 at the lower halves of the holes 114 is squeezed by flange portions 118 at the upper portions of the holes 114 through the holes 115, and is scattered onto the surface to be polished (polishing target surface) of the semiconductor wafer 101.

More specifically, assuming that the volume of the holes 114 which are not compressed is defined as Va and that the volume of the holes 114 which are compressed is defined as Vb (Va>Vb), the slurry 117 in an amount corresponding to (Va−Vb) is scattered to the outside of the holes 114 to reach the polishing target surface of the semiconductor wafer 101.

Figure 8A:
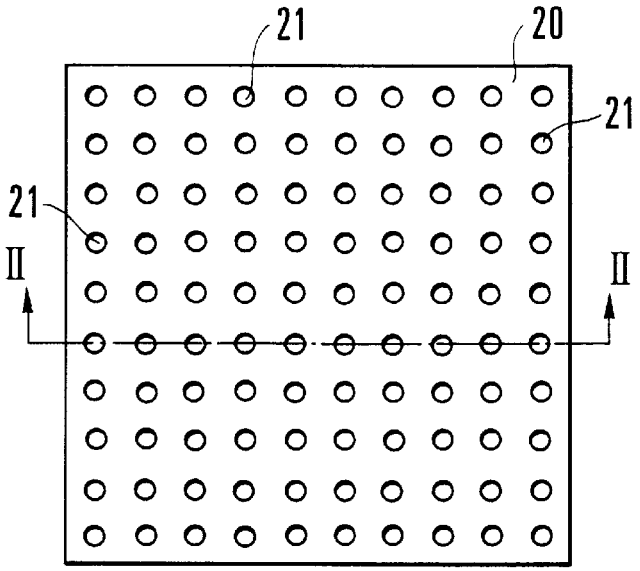
FIG. 8A PRIOR ART
FIG. 8A is a plan view of the conventional polishing pad.
Figure 8B:
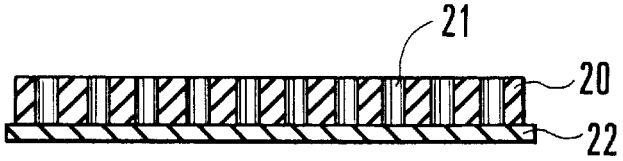
FIG. 8B PRIOR ART
FIG. 8B is a sectional view taken along the line II—II of FIG. 8A.
Figure 9:
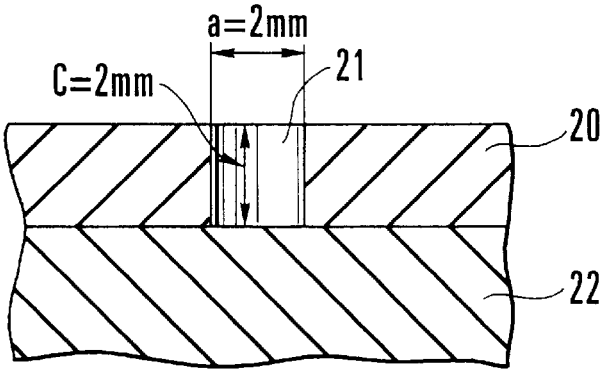
FIG. 9 PRIOR ART
FIG. 9 is an enlarged sectional view of the through hole portion of the polishing pad shown in FIGS. 8A and 8B.
Figure 10A:
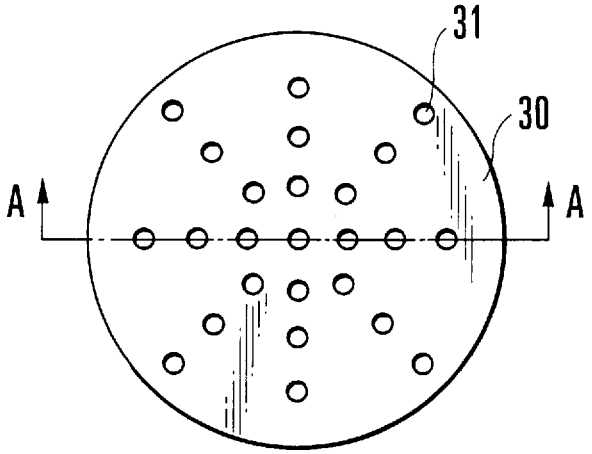
FIG. 10 A PRIOR ART
FIG. 10A is a plan view of the main part of another conventional polishing apparatus.
Figure 10B:
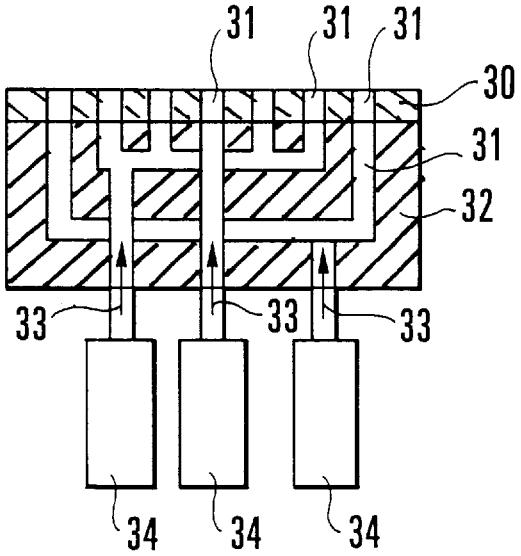
FIG. 10 B PRIOR ART
FIG. 10B is a sectional view taken along the line A—A of FIG. 10A.

As shown in FIGS. 8B and 9, if the holes serving as the slurry reservoirs extend with cross sections having the same area, the holes are not substantially deformed by the polishing pressure, and a sufficient amount of slurry cannot be fed onto the wafer surface. In contrast to this, according to the present invention, the holes 114 are formed to have convex longitudinal sections, so that a larger amount of slurry 117 can be fed onto the polishing target surface of the semiconductor wafer 101.

Figure 4:
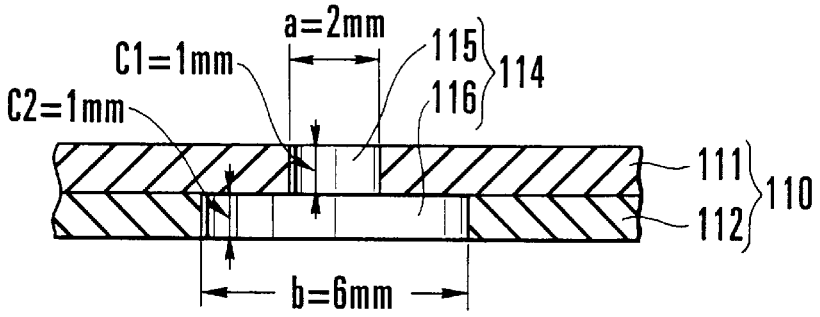
FIG. 4 is an enlarged sectional view of a through hole portion serving as the slurry reservoir of the polishing pad shown in FIGS. 2A and 2B.

Comparison will be made between the conventional case and the present invention. The cross section area at the upper portion of each through hole 114 of the present invention is set equal to that of each hole of the conventional case so that the contact area between the surface of the semiconductor wafer 101 and the polishing pad 110 becomes equal to that of the conventional case. The volume of the through hole 21 satisfying a=2 mm and c=2 mm of FIG. 9 is 2 $\pi mm^3$, whereas the volume of the through hole 114 satisfying a =2 mm, b=6 mm, c1=1 mm, and c2=1 mm of FIG. 4 is $10\pi mm^3$. As a result, the volume becomes 5 times that of the conventional case, so that the slurry 117 in an amount 5 times that of the conventional case can be reserved in the holes 114.

In this manner, with the polishing pad 110 according to the present invention, a large amount of slurry 117 can be reserved in the holes 114. Due to the deformation of the holes 114, a larger amount of slurry than in the conventional case can be fed to the polishing target surface of the semiconductor wafer 101.

Figure 5:
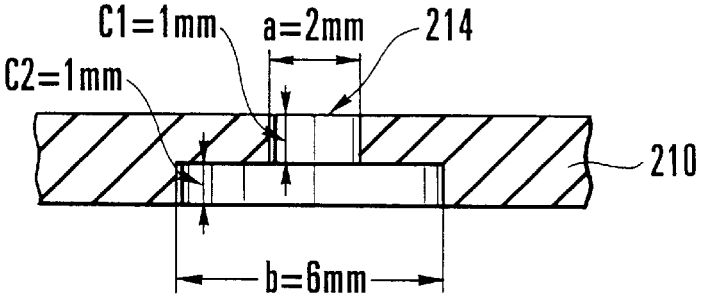
FIG. 5 is an enlarged sectional view showing another example of the polishing pad.
Figure 6:
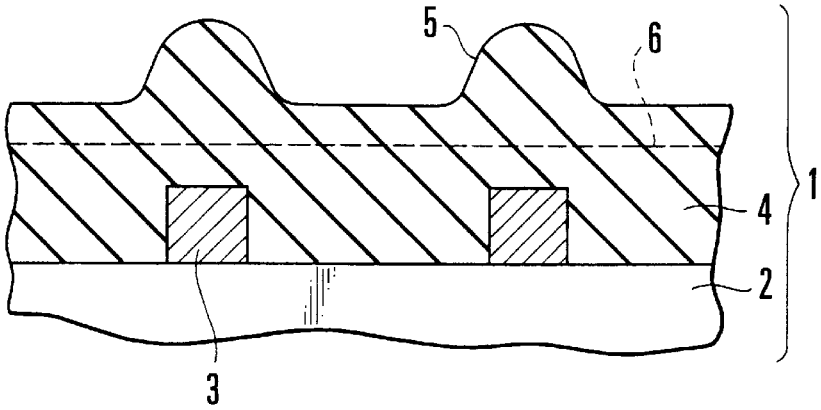
FIG. 6 is a schematic sectional view of a semiconductor wafer to be polished.
Figure 7A:
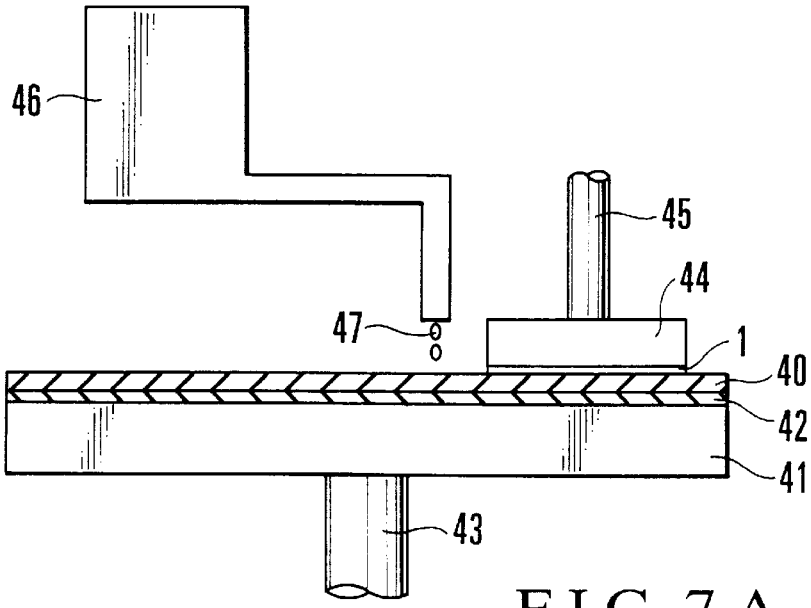
FIG. 7A PRIOR ART
FIG. 7A is a schematic view showing the arrangement of a conventional polishing apparatus employing the CMP method.
Figure 7B:
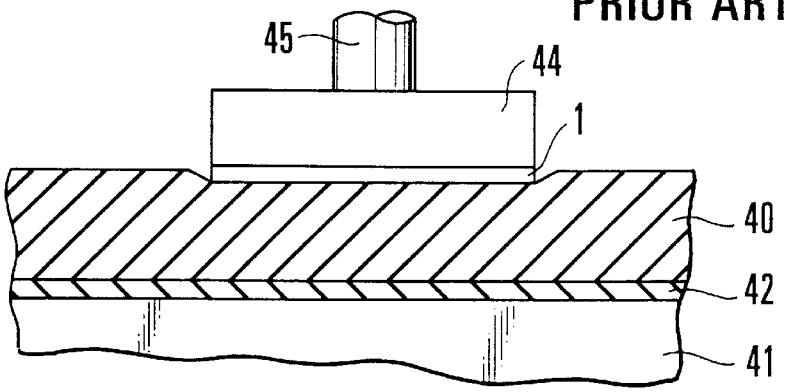
FIG. 7B PRIOR ART
FIG. 7B is an enlarged view of a semiconductor wafer and a polishing pad during polishing.

FIG. 5 shows another example of the polishing pad. Referring to FIG. 5, a polishing pad 210 consists of a single polishing pad layer, and holes formed in this polishing pad layer to have a convex shape are directly used as holes 214. With the polishing pad 210 shown in FIG. 5, the function of the polishing pad 110 shown in FIGS. 2A and 2B can be realized with a single polishing pad layer. Although hole formation is somewhat cumbersome, the cost of the material can be decreased.

As has been described above, according to the present invention, a larger amount of slurry can be held by the polishing pad without complicating the polishing apparatus, and during polishing, a larger amount of slurry can be fed to the surface of the polishing target member, so that the polishing target surface can be polished uniformly. Waste of the slurry is suppressed to decrease the flow rate (use amount) of the slurry.

What is claimed is:

1. A polishing pad made of a flexible material, said polishing pad comprising:

a first major surface urged by a rotatable polishing target member to polish a polishing target surface of the urged polishing target member by using a slurry;

a second major surface adhered to a rotatable platen; and a large number of holes extending between said first and second major surface and serving as slurry reservoirs, a single hole in the first major surface being in registration with a single hole in the second major surface, the holes having a larger opening area on said second major surface than that on said first major surface.

2. A pad according to claim 1, wherein said pad comprises:

a first polishing pad layer formed with a large number of first holes having a predetermined cross section area to constitute said first major surface; and a second polishing pad layer formed with a large number of second holes having a predetermined cross section area larger than that of the first holes to constitute said second major surface; and the holes are constituted by the first and second holes that are connected to each other by stacking said first and second polishing pad layers.

3. A pad according to claim 1, wherein said polishing pad comprises a single polishing pad layer including a portion from said first major surface to said second major surface; and the holes are formed to extend through said polishing pad layer to open in said first and second major surfaces with a predetermined opening area ratio.

4. A pad according to claim 1, wherein the holes have convex longitudinal sections.

5. A pad according to claim 1, wherein the holes are arranged in a matrix.

6. A polishing apparatus comprising:

a rotatable platen;

a polishing pad made of a flexible material and adhered on said platen, said polishing pad having a first major surface which is brought into contact with a polishing target member, a second major surface which is disposed toward said polishing pad, and a large number of holes serving as slurry reservoirs;

a wafer carrier which supports the polishing target member while rotating to urge the polishing target member against said polishing pad which is rotating; and a slurry supply unit for feeding a slurry to a polishing target surface of the polishing target member during polishing;

wherein the holes having a larger opening area on said second major surface than that on said first major surface and wherein there is a one to one correspondence between the holes in the first and second major surfaces.

7. An apparatus according to claim 6, wherein the holes have convex longitudinal sections.

8. An apparatus according to claim 6, further comprising an underlayer sheet arranged between said platen and said polishing pad.

* * * * *